United States Patent [19]

Prestel

[11] Patent Number: 4,721,939

[45] Date of Patent: Jan. 26, 1988

[54] ROTARY OR SLIDE POTENTIOMETER (SELECTOR SWITCH), AND METHOD FOR PRODUCING THE SAME

[75] Inventor: Fritz Prestel, Hausen a. Tann, Fed. Rep. of Germany

[73] Assignee: BSG-Schalttechnik GmbH & Co. KG, Balingen, Fed. Rep. of Germany

[21] Appl. No.: 844,833

[22] Filed: Mar. 27, 1986

[30] Foreign Application Priority Data

Apr. 1, 1985 [DE] Fed. Rep. of Germany ..... 3511872

[51] Int. Cl.[4] ..... H01C 10/32

[52] U.S. Cl. ..... 338/162; 338/163; 338/167; 338/174

[58] Field of Search ..... 338/162–174, 338/197; 29/610 R; 361/397, 400, 401, 403

[56] References Cited

U.S. PATENT DOCUMENTS 3,412,363 11/1968 Hatton ..... 338/174 X 4,521,761 6/1985 Welch ..... 338/174

*Primary Examiner*—E. A. Goldberg

*Assistant Examiner*—M. M. Lateef

*Attorney, Agent, or Firm*—McAulay, Fields, Fisher, Goldstein & Nissen

[57] ABSTRACT

In a potentiometer selector switch, it is proposed to arrange on a circuit board, in indirect arrangement, longitudinal contacts consisting of wire bridges which are swept by the wiper of a regulating element forming the actuating element of the switch when the wiper is rotated or displaced. The wire bridges forming the longitudinal contacts are insulated from each other on one side of the circuit board and at least one end of each of the bridges passes through the board to the conductor side where it is connected electrically and fixed mechanically, preferably by dip soldering.

10 Claims, 4 Drawing Figures

ROTARY OR SLIDE POTENTIOMETER (SELECTOR SWITCH), AND METHOD FOR PRODUCING THE SAME

BACKGROUND OF THE INVENTION

The present invention relates to a rotary or slide potentiometer (acting as a selector switch), and a method for producing the same.

For the purpose of controlling or regulating the speed of electric machines, or of temperatures, for example of heating appliances, ironing appliances, or the like, it has been known before to provide, in addition to the respective electronic or electric circuit which may consist of a conventional phase control or the like, regulating means or actuating elements which can be actuated by the operator to pre-set a specific speed or a pre-determined temperature.

While these regulating means consist usually of potentiometers in the form of rotary or slide potentiometers, one very often provides additional locking means which are felt by the operator when he adjusts or turns the actuating means so that they will effect the desired regulating steps. This type of regulation is not only sufficiently exact for most applications, but in addition preferred because it provides the user with clear information on the current operating condition—in the case of an iron, for example, a first or lower temperature range for sensitive fabrics, a mean temperature range and a full-load range. When the existing potentiometer is, thus, anyway employed in steps only so that its transition areas are substantially superfluous, the use of such potentiometers will provide the considerable additional disadvantage that their inaccuracies are as high as ±20% so that under certain circumstances one would even have to consider an additional need for calibration.

If one chooses to select switches for this purpose—a solution which would seem imaginable—the disadvantage of the considerably higher switch requirements of a selector switch would even be aggravated by the fact that the conducting paths of the circuit board would have to be upgraded at substantial cost, at least in the switch area, i.e. the copper layers would have to be silver-plated, if they are swept by a switching contact. Further, one would in this case have to put up with the additional disadvantage that certain circuit elements have to be accommodated on the printed circuit side of the board because not all components can be accommodated on the component side—a fact which may give rise to assembly and space problems. Finally, upgrading of the conductive paths would again lead only to flat contact points while for efficient contact-making the surfaces getting into contact with each other should, ideally, have a shape as close as possible to spherical. And the use of punched parts in the construction of the switch would also require the said parts, which are usually made from copper, to be coated with carbon or gold or silver, and render their assembly correspondingly troublesome.

Now, it is the object of the present invention to provide a rotary or slide potentiometer acting as a selector switch, which can be used without any problems for the purposes described above, which does not give any problems as regards assembly and application, and which on the other hand offers considerably higher precision than, for example, noncalibrated potentiometers with mechanical stop means.

ADVANTAGES OF THE INVENTION

According to the invention, these objectives are achieved by the advantage of a particularly simple and low-cost structure, in particular due to the cost-saving, simple and time-saving arrangement of the countercontacts relative to the wiper, combined with an extremely simple assembly and excellent contact-making properties, even over long periods of time, it being an additional advantage that the pre-set values to be reproduced can, basically, be selected with any desired degree of accuracy, simply by providing resistors with the corresponding, i.e. close, tolerances.

The invention is based on the idea that if one departs from the potentiometer principle as such, the functions can be separated, while maintaining the continuous regulating movement for the desired speeds, temperatures and the like, by providing constant electric set values for pre-determined ranges, which can be identified by mechanical stops or in any case corresponding markings, and which extend over a pre-determined variation width right and left to the markings or stops, because only one pre-determined electric value is to be obtained over the said adjusting range so that, consequently, it is necessary only to select one desired set value.

If, therefore, according to the present invention, the potentiometer or switch is operated in the manner usual for a rotary or slide potentiometer or a rotary or slide switch with mechanical stops or position markings, then the electric effect will be that of a selector switch as a series of mutually insulated contacts (in the electrical sense) is moved successively into active contact with one countercontact. As a whole, the movement of the switch is, however, continuous and sliding so that the invention may with the same right be described also as a rotary or slide potentiometer.

A particular advantage regarding the production of the potentiometer according to the invention is seen in the fact that the countercontacts for the wiper, which are contacted by the latter in the course of its (continuous) movement, consist of wire bridges provided on the same circuit board on which the essential elements of the switch are directly mounted. In detail, the contact arrangement is such—and this an essential inventive element—that the contacts have the shape of longitudinal wire contacts consisting, for example, of electrolytic copper or any other usual high-quality contact material, which are assembled on the circuit board automatically. A conventional assembly machine draws conductive paths of a pre-determined length off a wire reel and fixes them on the circuit board in the same manner in which in would mount a resistor in pre-determined openings of the circuit board from the equipment side. In other words: The countercontacts for the wiper of the rotary or slide potentiometer according to the invention are longitudinal contacts taking the form of wires, the bent-off ends of which are introduced by the assembly machine automatically into two openings in the circuit board, and then bent over, the fixing connection between the wire bridges and the side of the circuit boards being realized in the usual, identical manner and at the same time as all the other electric connections on the respective circuit board, i.e. usually by dip soldering or the like. The wire bridges are applied directly on the equipment side of the circuit board and fixed to the other side by the soldering process so that the circuit board acts as a carrier and support and/or case for the longitudinal contacts, while the actuating element of the rotary or slide switch or rotary or slide potentiometer thus formed, which also carries the wiper and the collector path, may be fixed to the circuit board in any desired manner, preferably by passing a central axis of the rotary element, which is acted upon by the operator, through an opening in the circuit board, and locking and retaining it on the other side by resiliently returning stop pins with lugs.

The features described in the sub-claims permit advantageous improvements and further developments of the invention. A particularly favorable arrangement is obtained when the rotary or slide potentiometer is additionally designed to permit momentaneous switching, i.e. for making contact only in response to the actuation of a key, either momentaneously or as long as the key is actually actuated, and this either in addition or alternatively to its normal operation. To this end, the actuating element is composed of two parts which may, for example, slide within each other in the manner of a telescope, and when the key is pressed down a lug provided on the sliding part moves a contact element of the wiper into contact with one of the wire bridges forming the longitudinal contacts.

BRIEF DESCRIPTION OF THE DRAWING

One embodiment of the invention will be described hereafter with reference to the drawing in which.

DESCRIPTION OF THE EMBODIMENTS

The basic concept of the present invention consists in the idea to provide, in a circuit element designed for making stepped electric contact, on the one hand a continuously operable wiper with associated, continuously contacted collector return line, and to design on the other hand the counterelements contacted by the wiper in the form of wire bridges mounted directly on the circuit board. This ensures directly an adjustment in steps, with no change of the electric value relative to the desired value occurring over a pre-determined setting range, because the contacted wire bridge is always the same. On the other hand, a plurality of switching steps can be swept advantageously, and the wiper may be designed in such a manner that in the transition areas it bridges momentaneously two steps, i.e. contacts both wire bridges. If, however, this should be undesirable (exceptionally) for any reason whatever, the wiper may also slide over an insulating piece which may, for example, consist of an intermediate wire bridge without electric connection on the conductor side.

Figure 1:
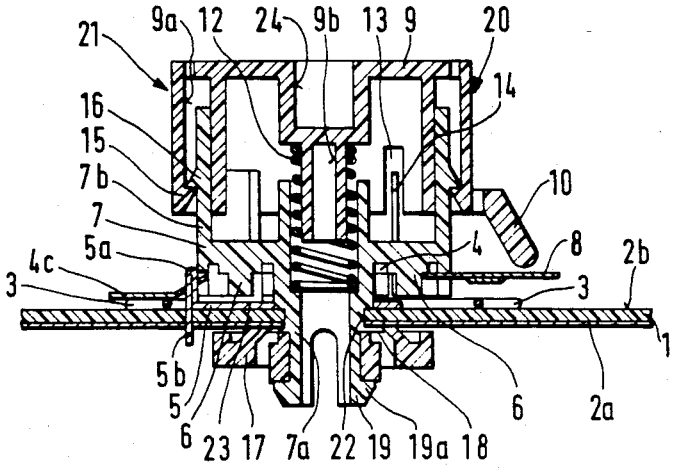
FIG. 1 shows a longitudinal cross-section through a preferred embodiment of the invention in the form of a rotary potentiometer or rotary selector switch, mounted on a circuit board shown in part only.

In the representation shown in FIG. 1, the circuit board or print board is designated by reference numeral 1, its conductor side by 2*a*, and its equipment side by 2*b*. The embodiment of the invention illustrated in FIG. 1 is a rotary potentiometer or rotary selector switch with additional key, it being understood that the invention is not limited to this design but extends to any type of regulating potentiometer or step switch. Any modifications that may be required for such applications, using the inventive features, are within the reach of any man of the art. The circuit board 1 serves as carrier for any desired electronic components, resistors, integrated circuit components, or the like, not shown in the drawing. It further serves, by means of the Cu conductor paths provided on its conductor side for linking these electronic components and the switching steps realized by the invention. In the following specification, the invention will be described with reference to its embodiment as a rotary potentiometer and will be described as such throughout the specification, it being understood that switching or contact-making is effected in steps and that, viewed from a different point of view, this designation also includes a rotary or slide selector switch instead of such potentiometers.

The actuating element 20 for the rotary potentiometer 21 upon which the user can act directly for the intended adjustment, comprises two parts, namely a lower part 8—viewed in the plane of the drawing—with an axis of rotation 7*a*, which is supported in axially fixed but rotating relationship in an opening or passage in the circuit board, and an upper part 9 which provides an additional possibility of axial movement relative to the circuit board by the fact that in can be pressed down in the manner of a telescope in a direction towards the circuit board over a greater portion of the lower part 7, being returned to its original position by a biasing spring 12. Both parts 7 and 9 are generally pot-shaped; the lower part 7 of the actuating element 20 passes with its (integral) axis 7*a* through the bearing opening 22 of the board 1 and is fixed on the opposite side, preferably via a locking sleeve 17 whose passage opening is embraced by resilient pins 19 comprising each a lug 19*a* so that when the actuating part 20 is pressed upon the circuit board, the whole assembly is locked on the circuit board once the axis 7*a* with its resilient pins 19 has passed also the locking sleeve 17. The assembly is locked resiliently because the locking sleeve 17 comprises integrally formed, upwardly projecting spring elements 18 which in the locked position prevent any axial play, but ensure uniform, trouble-free rotation of the actuating element 20.

In the area of the passage opening 22, there is provided on the circuit board 1 a collector ring 23 which is separate from the actuating element 20 and surrounds the passage opening 22 preferably in the form of a ring and which may also be described as wiper path. The said collector ring 23 consists of an electrically highly conductive material and comprises an extension 5 extending radially from the said collector ring path 23 to form initially a turned-up portion serving as a stop for the rotary movement of the actuating element and to pass thereafter at 5*b* through the circuit board 1, thus establishing the connection with a predetermined conductor path.

Figure 3A:
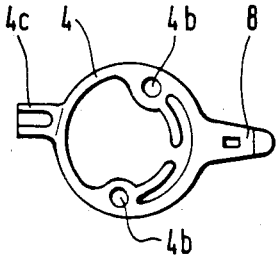
FIGS. 3*a* and 3*b* show reduced-scale representations of the wiper with an additional integral contact for momentaneous contact-making, and a cross-section through a possible embodiment of a wire bridge forming a longitudinal contact.

The lower part of the actuating element 7 supports the wiper 4 which has the shape illustrated in detail in FIG. 3*a*, and urges it against the circuit board 1. The wiper 4 bears against the collector ring path 5 by means of two, preferably integral, wiper contact reeds 4*b*, biased in downward direction in the plane of the drawing, i.e. towards the collector ring path, thus establishing at the same time the electric contact with the collector ring path, and is fixed at the lower actuating portion 7 by means of two pins 6 passing through openings 4*b* of the wiper 4. The wiper 4 consists of a suitable resilient, electrically highly conductive material and comprises a first wiper finger 4c for establishing the electric contact when the actuating element 20 is rotated, as will be described further below. A further contact reed 8 serving to establish momentaneous contacts in a manner which will be described further below, is provided opposite the wiper finger 4c, but may in principle be arranged at any desired point.

The lower actuating portion 7 extends upwardly, as indicated at 7b, to form a sleeve-like element. The said sleeve 7b engages an annular recess 9a in the upper actuating portion 9 by means of interacting lugs 15, 16 so that the parts 7, 8 can be pressed into each other against the action of the biasing spring 12, but cannot be released thereafter once the lugs have engaged each other. In order to cause the upper portion 9 to rotate with the lower portion 7, the latter may, for example, be provided with ribs 14 engaging corresponding recesses 13 in the said upper portion 9. The biasing spring 12 surrounds a central axis 9b of the upper portion 9 and rests against a lower shoulder on the lower portion 7. The actuating element 20 may be actuated by the operator either directly or by an additional rotating element engaging an upper central slot 24.

Figure 2:
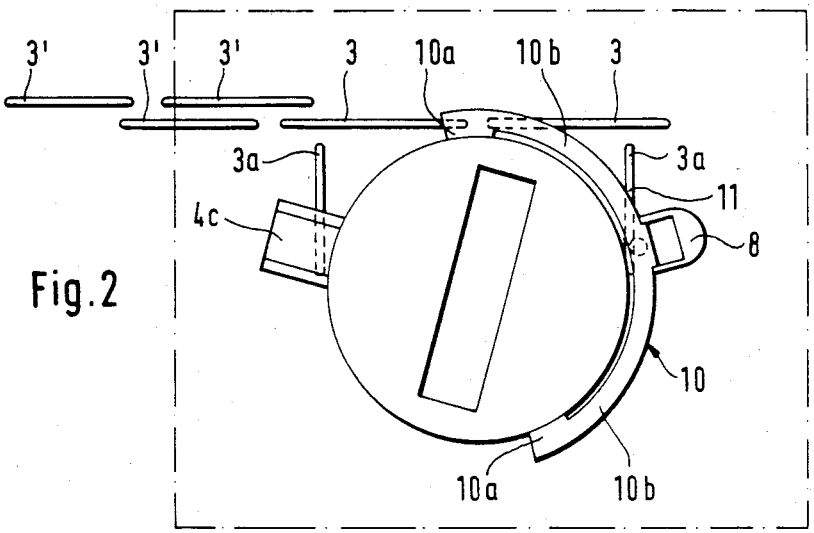
FIG. 2 shows a top view of the embodiment of the invention according to FIG. 1.
Figure 3B:
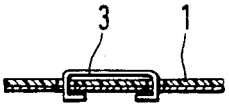

It is an essential feature of the invention that the countercontacts which are contacted by the wiper finger 4c during a rotary, or generally sliding movement of the actuating element, are designed as wire ends in the form of wire bridges 3 lying flat on the equipment side 2b of the circuit board 1, or exhibiting in any case a flat course, the wiper finger 4c which may additionally be provided with a spherical protrusion on its lower end resting resiliently against the said bridges and sliding on them during any rotary movement. The wire bridges 3 may be arranged about the angle of rotation of the rotary potentiometer 21, either in a square pattern as shown in FIG. 2, or in any desired configuration. To say it in other words: The countercontacts for the wiper fingers 4c take the form of successive longitudinal contacts formed by free wire ends which consist of a suitable, highly conductive material, preferably electrolytic copper, and are arranged in the form of wire bridges on the equipment side of the circuit board and which, as shown in FIG. 3b, have their ends passed through the usual openings in the circuit board 1, which normally serve for receiving the wire ends of resistors, capacitors or other circuit elements, to the conductor side of the board where they are bent over.

It is, therefore, a further preferred feature of the present invention to produce these wire bridges forming the longitudinal contacts by an automatic assembly method in which, instead of assembling resistors or other elements as usual, the automatic assembly machine which is normally available and known as such, processes wire ends cut off a supply reel, arranges them in the existing passage openings of the circuit board 1, and bends the ends over to fix the wire bridges forming the longitudinal contacts provisionally, whereafter they are soldered upon the lower face and simultaneously connected with the respective conductor paths. Such an assembly method is particularly cost-saving and simple and, above all, of particular advantage also for the later use of the rotary potentiometer, because the wire bridges 3 and/or the conductor paths connected thereto, permit resistors, including such with comparatively close tolerances, to be connected without any problems and preferably also immediately with the same assembly machine, so that very exact electric setting values can be achieved.

According to a preferred embodiment of the invention, the wiper finger 4c is sufficiently wide to ensure that in the transition area between the individual switching steps it contacts for an instant two of the wire bridges forming the longitudinal contacts arranged at the predetermined spacing 3a (compare FIG. 2) on the equipment side, which means that the two wire bridges forming the longitudinal contacts are bridged and, thus, connected during the rotary movement. This may be of advantage electrically, but it is of course also possible to insulate the bridges against each other, for example by causing the wiper to slide off the one wire bridge before it contacts the next one, or by providing non-connected wire bridges, for example of a shorter length, between every two wire bridges.

Another advantageous embodiment of the present invention provides the additional possibility to establish momentary contacts with the aid of the described configuration of the actuating element, wiper and countercontacts. To this end, a radially projecting contact reed 8 formed integrally with the wiper 4 is provided which in the normal position, when the two parts 7 and 8 are not telescoped into each other, has a predetermined distance from a given or any one of the wire bridges 3 forming the longitudinal contacts. If in a particular switching position, for example in the off position, when the wiper finger 4c bears against the turned-up projection 5a of the collector ring path 5, a specific signal, for example indicative of the maximum speed or a particular temperature, is desired, then the upper portion 9 is pressed down to cause a lug 10 fixed on the upper portion 9 and projecting radially towards the resilient contact reed 8 of the wiper 4 to press down the contact reed 8 for making contact with the respective longitudinal countercontact. The pressing movement is resilient and ensures sufficient contact-making because the contact reed 8 is pressed down a little too far so that it comes to rest against the associated longitudinal countercontact at a certain pressure when the parts 7 and 9 are in their fully telescoped position. To this end, the lug 10 on the upper portion 9 takes, preferably, the form of a spring element molded integrally with the upper actuating portion 9; the shape of the spring can be seen best in FIG. 2. It is fixed on projections 10a on the upper portion 9 arranged approximately diametrically opposite each other, and extends on both sides in annular form over the segments 10b which are open towards the upper portion 9, right to the actuating lug 10 which, thus, is also elastically resilient, absorbs the excessive movement of the telescoping parts 7, 9 and provides the bearing force for establishing the contact.

All features mentioned or shown in the above description, the following claims and the drawing may be essential to the invention either alone or in any combination thereof.

It goes without saying that the longitudinal contacts forming the wire bridges may also be arranged, as indicated in FIGS. 2 and 3', in longitudinal arrangement in which case they may be contacted successively by a longitudinally displaced wiper/contact element of a slide potentiometer or slide selector switch.

I claim:

1. A potentiometer selector switch adapted to be mounted on a planar circuit board having an upper surface and a lower surface having conducting elements thereon, said potentiometer having a collector, a wiper in sliding and electrical contact with said collector and having a portion thereof in spaced and parallel relationship to the upper surface of the circuit board, and actuating means for moving said wiper relative to the circuit board; characterized in that said actuating means includes mounting means for mounting said actuating means on the upper surface of said circuit board, and a plurality of mutually insulated longitudinally extending contacts on the upper surface of said circuit board positioned to be sequentially engaged by said wiper in response to the operation thereof, each of said plurality of contacts having at least one end thereof extending through said board and being electrically connected to a selected conducting element.

2. A potentiometer selector switch according to claim 1, characterized in that the collector is provided on the upper surface of the circuit board and a projecting end portion of said collector extends through the circuit board and is connected to a conducting element.

3. A potentiometer selector switch according to claim 1, wherein said wiper is provided with recesses, and pins on said actuating means received in said recesses to mount said wiper thereon, said wiper being fabricated from a resilient material, whereby said wiper resiliently engages said contacts.

4. A potentiometer selector switch according to claim 1, in which said mounting means is operable to mount said actuating means for sliding movement on said circuit board, said longitudinally extending contacts being positioned on said circuit board in end-to-end relationship along a straight line.

5. A potentiometer selector switch as in claim 4, in which said longitudinally extending contacts comprise a first plurality of contacts, and a second plurality of contacts in end-to-end relationship and extending along a straight line in mutually offset relationship to said first plurality of contacts.

6. A potentiometer selector switch according to claim 1, in which said mounting means includes a central supporting shaft extending through an opening in the circuit board, said shaft having projecting locking pins for securing said shaft to said circuit board to permit rotary movement of said actuating means.

7. A potentiometer selector switch as in claim 6, and a sleeve on the lower surface of said circuit board receiving said shaft therethrough, said locking pins engaging the lower surface of said sleeve to lock said shaft in position on said board, and integrally formed springs on said sleeve engaging the lower surface of said board to bias said shaft downwardly to prevent axial movement of said actuating means.

8. A potentiometer selector switch according to claim 1, in which said wiper comprises a circular shape having a projecting wiper finger for contacting said longitudinally extending contacts, and a radially projecting resilient reed in spaced relationship to said longitudinally extending contacts.

9. A potentiometer selector switch as in claim 8, in which said actuating means comprises a lower section and an upper section telescopically received in said lower section, biasing means for biasing said upper section away from said lower section, said upper section being provided with a depending lug engageable with said contact reed to push said contact reed into electrical engagement with a selected one of said longitudinally extending contacts to establish momentary contact in response to movement of said upper section toward said lower section.

10. A potentiometer selector switch as in claim 9, in which said lug is resiliently connected to said upper section, whereby a biasing force is applied to said lug as said lug moves said reed into engagement with said selected contact.

* * * * *